US006886538B2

(12) United States Patent
Lee et al.

(10) Patent No.: US 6,886,538 B2
(45) Date of Patent: May 3, 2005

(54) INTAKE MANIFOLD HAVING INTEGRATED FEATURES

(75) Inventors: Ki-Ho Lee, Windsor (CA); James Kenneth Vanderveen, Windsor (CA)

(73) Assignee: Siemens VDO Automotive, Inc., CHatham (CA)

( * ) Notice: Subject to any disclaimer, the term of this patent is extended or adjusted under 35 U.S.C. 154(b) by 0 days.

(21) Appl. No.: 10/636,384

(22) Filed: Aug. 7, 2003

(65) Prior Publication Data

US 2004/0025848 A1 Feb. 12, 2004

Related U.S. Application Data

(60) Provisional application No. 60/401,514, filed on Aug. 7, 2002.

(51) Int. Cl.[7] ..... F02M 61/14; F02M 35/10

(52) U.S. Cl. ..... 123/470; 123/143 C; 123/198 E; 123/184.61; 439/130

(58) Field of Search ..... 123/470, 184.61, 123/143 C, 198 E, 468, 469; 439/130

(56) References Cited

U.S. PATENT DOCUMENTS 4,570,601 A * 2/1986 Ito et al. ..... 123/468
4,929,196 A * 5/1990 Ponn et al. ..... 439/620
4,966,120 A * 10/1990 Itoh et al. ..... 123/516
5,211,149 A * 5/1993 DeGrace, Jr. ..... 123/470
5,598,824 A * 2/1997 Treusch et al. ..... 123/470
5,743,235 A * 4/1998 Lueder ..... 123/468
6,341,967 B1 * 1/2002 Nabeshima et al. ..... 439/130
6,494,174 B1 * 12/2002 Daly ..... 123/143 C
6,497,218 B2 * 12/2002 Warner et al. ..... 123/468
6,622,700 B2 * 9/2003 Lee et al. ..... 123/456
6,688,290 B2 * 2/2004 Zehnal et al. ..... 123/468
6,758,192 B2 * 7/2004 Vanderveen et al. ..... 123/456
6,769,410 B2 * 8/2004 Lee et al. ..... 123/470

* cited by examiner

*Primary Examiner*—Weilun Lo

(57) ABSTRACT

A vehicle fuel intake system (10) includes an intake manifold (14), an injector pack assembly (18) and an air cleaner assembly (16). The injector pack assembly (18) includes an encapsulated lead frame (36) that provides electrical communication to fuel injectors (26). The intake manifold defines a fuel rail (22) and a cavity (24). Fuel vapors permeating from the fuel rail (22) are trapped in the cavity (24) and channeled back into the air intake passages (20). The air cleaner assembly (16) includes a filter (28) for absorbing fuel vapor emissions from unburned fuel escaping a non-operating engine (12). An actuator (30) moves the filter (28) between an open and closed position. Once the engine begins operation, the actuator (30) opens the filter (28) to allow unrestricted airflow through the intake manifold (14).

11 Claims, 7 Drawing Sheets

Fig-8
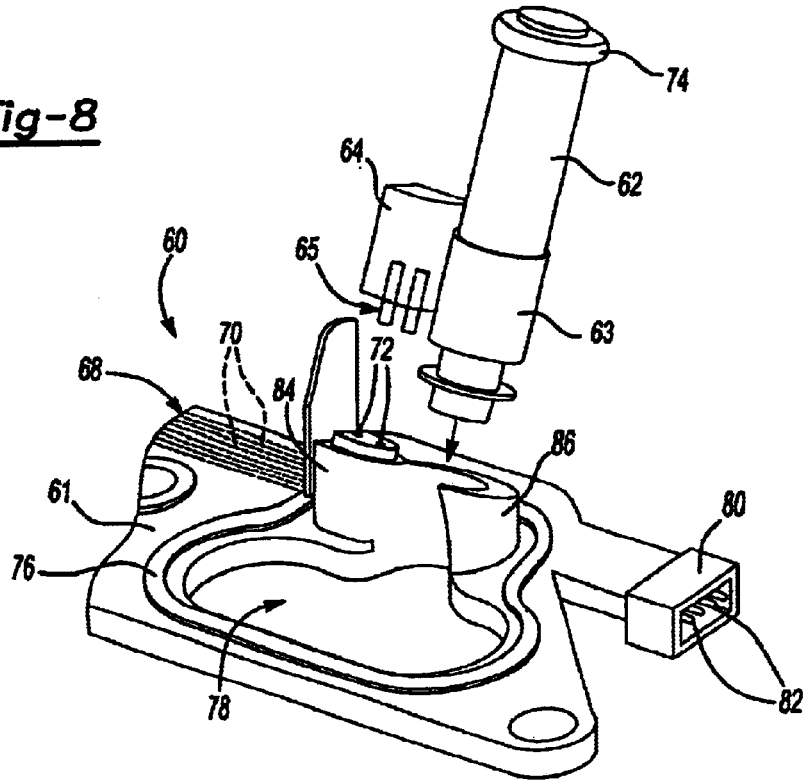
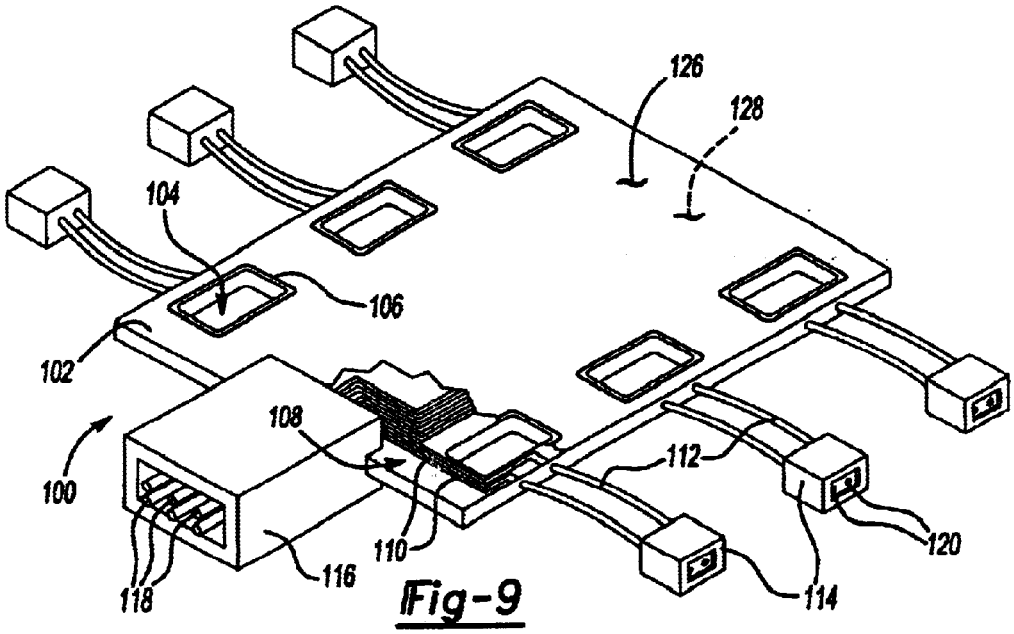
Fig-9

INTAKE MANIFOLD HAVING INTEGRATED FEATURES

This application claims priority to U.S. Provisional Application No. 60/401,514 filed on Aug. 7, 2002.

BACKGROUND OF THE INVENTION

This invention relates generally to a non-metallic intake manifold, and specifically to a non-metallic intake manifold including an integrated wiring harness, seal and fuel injector assembly and hydrocarbon emission minimizing features.

Typically, a fuel-injected engine includes a plurality of fuel injectors mounted within an intake manifold. Each fuel injector is in fluid communication with a fuel source and is selectively actuated to meter a desired amount of fuel into a combustion chamber. Electric signals to control the fuel injectors are typically communicated through a conventional wire harness including a main connector attached to the controller and a plurality of wires that are routed to individual fuel injectors.

An intake manifold provides airflow for combination with fuel for combustion within a combustion chamber. The intake manifold is typically mounted to a cylinder head of the engine. The intake opening into the combustion chamber is sealed to prevent leakage of air that could disrupt the metered flow of air. Seals are provided that prevent air infiltration into individual passages. Typically, a seal is a separate component that is disposed between the flange assembly and the intake manifold.

A fuel rail provides fuel to the various fuel injectors located at each combustion chamber. The fuel rail is typically fabricated from a metallic material to prevent permeation of fuel vapors into the atmosphere. Fuel within the fuel rail is pressurized to pressure above that of the surrounding environment and therefore generates a bias toward emitting fuel vapors through joints and interfaces with the fuel injectors. Seals at these interfaces prevent most fuel vapor from escaping into the atmosphere.

The use of non-metallic materials encourages the incorporation of features currently installed as separate parts. However, current standards regarding permeation of fuel vapors to the atmosphere have prevented the integration of a plastic fuel rail. A non-metallic fuel rail can experience some fuel permeation to the atmosphere and therefore are not desirable for some automotive applications. In such applications a metallic fuel rail may be combined with the non-metallic intake manifold.

The typical intake manifold includes many different components that are currently assembled individually. As appreciated, each separate assembly operation provides an opportunity for inconsistencies to affect the overall function of the completed intake manifold.

Accordingly, it is desirable to design an integrated assembly that incorporates several different functions such as sealing, electrical, and fuel metering to provide for quality improvements, performance improvements along with decreases in cost and assembly time.

SUMMARY OF THE INVENTION

The present invention is a fuel intake manifold assembly that includes an integrated fuel injector wire harness/seal assembly, a plastic fuel rail and features minimizing emission of fuel vapors.

The fuel intake assembly includes an injector pack assembled to an intake manifold. The injector pack includes lead frame wiring for communicating electric signals to the fuel injectors. A main connector is integrally formed within the injector pack and communicates electric energy and signals between a vehicle controller and the fuel injector. The injector pack includes integral seals for sealing against the intake manifold and the engine and seals for providing a seal with the fuel source. The injector pack consolidates the seals, electrical conductors and fuel injectors required for operation of the fuel intake system.

The intake manifold defines a fuel rail for supplying fuel to the fuel injectors and a plurality of air intake passages. A cavity formed within the intake manifold portion shares a common wall with the fuel rail. Fuel within the fuel rail that permeates through the common wall is trapped in the cavity. Openings within the cavity communicate the fuel vapors to at least one of the air intake passages. Fuel vapors within the air intake passages are drawn into the engine and burned during combustion.

When the engine is not functioning, unburned fuel vapors are released into the air intake manifold and system. Because the air induction system is open to atmosphere, the fuel vapors are eventually released into the atmosphere. The air induction system of this invention includes a fuel vapor absorber that is closed when the engine is not functioning to prevent emission of fuel vapors through the air intake system. Once engine operation begins, the fuel vapor absorber is opened to allow unrestricted airflow through the air intake system. The fuel vapor absorber is disposed within the air-cleaning element of the air intake system.

Accordingly, the present invention provides an integrated assembly that incorporates sealing, electrical, and fuel metering functions along with minimizing emission of fuel vapors into the atmosphere to provide quality improvements, performance improvements along with decreasing overall costs and assembly time.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows:

FIG. 8 is a perspective view of another injector pack designed according to this invention;

FIG. 9 is a perspective view of an encapsulated lead frame assembly according to this invention;

DETAILED DESCRIPTION OF THE PREFERRED EMBODIMENT

Figure 1:
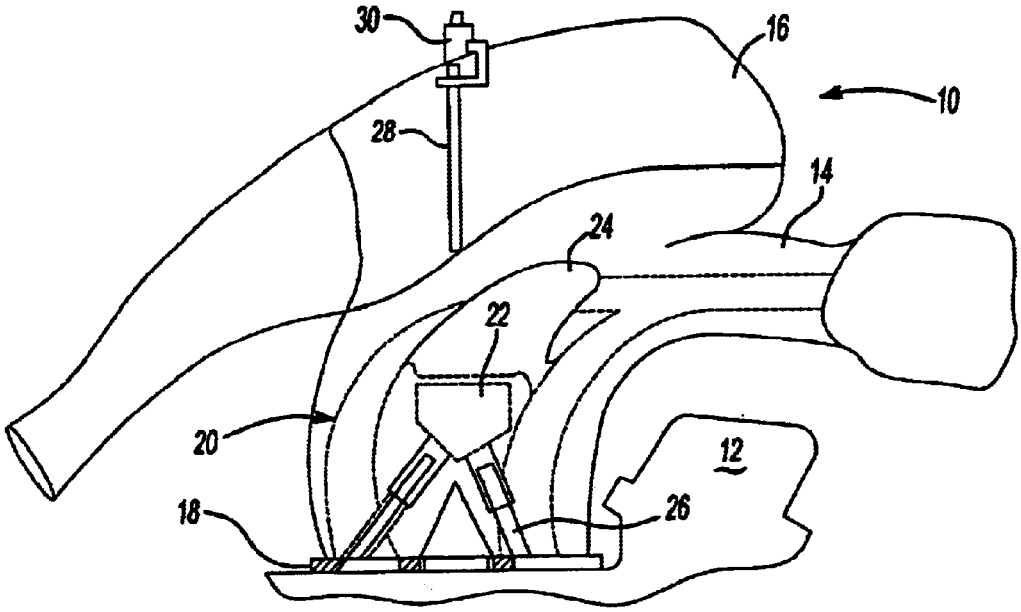
FIG. 1 is a schematic illustration of the intake manifold system according to of this invention.

Referring to FIG. 1, a vehicle fuel intake system 10 includes an intake manifold 14, an injector pack assembly 18 and an air cleaner assembly 16. The injector pack assembly 18 includes an encapsulated lead frame 36 (FIG. 2) that provides electrical communication to fuel injectors 26. The intake manifold 14 defines a fuel rail 22 and a cavity 24. Fuel vapors permeating from the fuel rail 22 are trapped in the cavity 24 and channeled back into the air intake passages 20. The air cleaner assembly 16 includes a filter 28 for absorbing fuel vapor emissions emanating from unburned fuel escaping when the engine 12 is not operating. The filter 28 is actuated between an open and closed position by an actuator 30. The filter 28 only is closed when the engine 12 is not operating to prevent the escape of fuel vapors. Once the engine begins operations, the actuator 30 opens the filter 28 to allow unrestricted airflow through the intake manifold 14.

Figure 2:
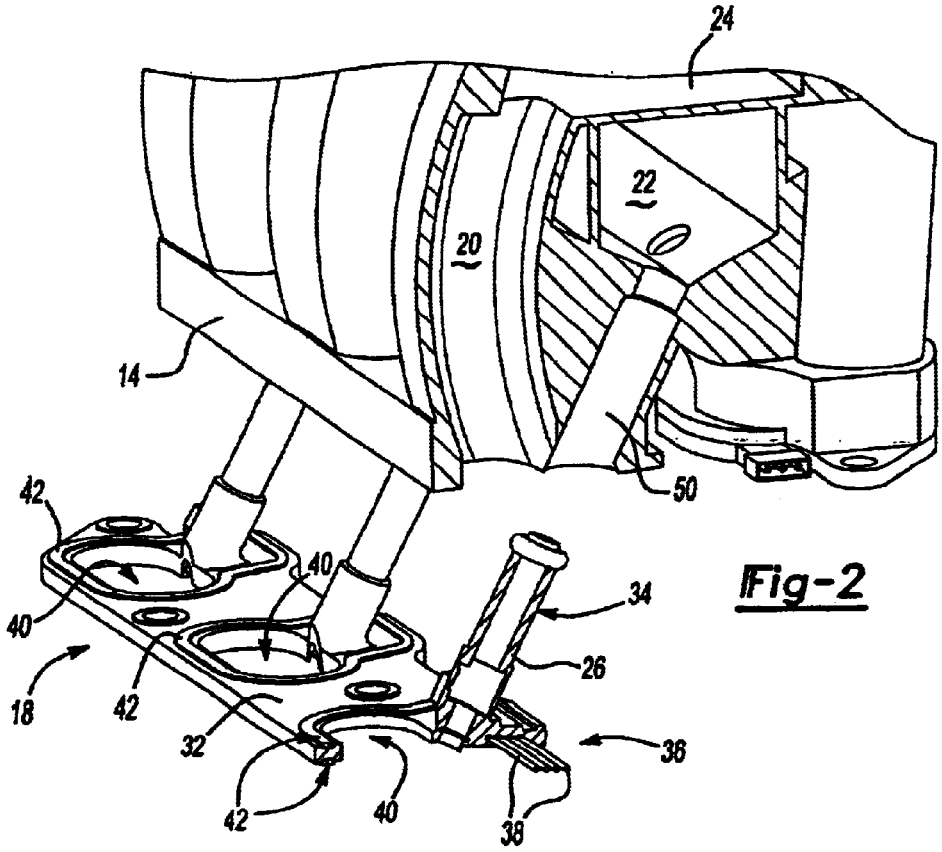
FIG. 2, is perspective view of an injector pack assembly prior to assembly with the intake manifold.

Referring to FIG. 2, the injector pack 18 includes a plate segment 32 and a cylindrical mount 34 for receiving the fuel injector 26. The lead frame assembly 36 is encapsulated within the injector pack 18 and includes a plurality of conductors 38. The lead frame assembly 36 is integrated into the injector pack 18 to conceal and protect the conductors 38 that provide electrical energy and signals to the fuel injector 26.

The plate segment 32 defines an intake opening 40 for an air/fuel mixture into a combustion chamber (not shown) of the engine 12. Seals 42 seal between the intake manifold 14 and the injector pack 18 about the intake opening 40. Further, the seals 42 create a seal between the injector pack 18 and a mounting surface of the engine 12 such as for example a cylinder head as is known.

Figure 3:
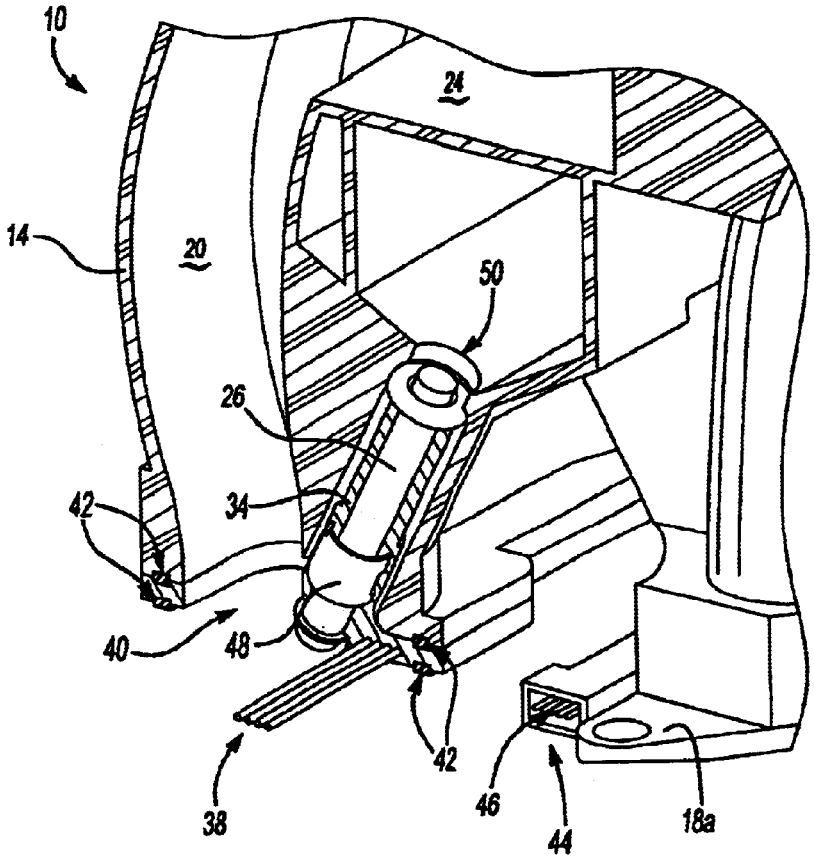
FIG. 3 is a partial cross-sectional view of the injector pack assembly mounted within the intake manifold.

Referring to FIG. 3, a partial cross-sectional view of the injector pack 18 is shown installed within the intake manifold 14. In this view another injector pack 18A is also shown to illustrate how the injector packs 18,18A appear once assembled within the intake manifold 14.

The injector pack 18, 18A includes a main connector 44 having a plurality of connector pins 46. The main connector 44 is illustrated as a box structure integral with the injector pack 18. The main connector 44 includes the connector pins 46 that correspond to a connector of the vehicle controller that controls actuation of the fuel injector 26. The specific configuration of the outer surface of the main connector 44 can include locking and alignment features as are known to a worker skilled in the art. The main connector 44 is preferably an integrally formed segment of the injector pack 18 to provide a single unified structure that receives the fuel injector 26 and houses the necessary wiring to drive and actuate the fuel injector 26. Further, integration of the lead frame assembly 36 within the injector pack 18 eliminates a separate wire harness assembly that is typically associated with a fuel injector system.

The fuel injector 26 is an electromechanical device that requires a coil 48 to operate. The coil 48 is integrated into a mount cylinder 34 and connected to the lead frame assembly 36. The coil 48 is encapsulated within the mount cylinder 34 of the injector pack 18. The fuel injector 26 is received into the mount cylinder 34 in relation to the position of the coil 48 such that the magnetic field generated by the coil 48 selectively actuates the fuel injector 26 to meter fuel through the intake opening 40. The coil 48 is an electrical device attached to the lead frame assembly 36 and over molded within the injector pack 18. Over molding the lead frame assembly 36 and coil 48 within the injector pack 18 protects and integrates the entire electrical portion of the fuel injection system, thereby substantially reducing exposure of electrical conductors to the harsh under hood environment. Further, integration of the electrical components (lead frame assembly 36 and coil 48) reduces assembly time and costs by eliminating assembly steps required for conventional prior art wire harness assemblies.

The intake manifold 14 includes the air passages 20 for delivering air to the combustion chamber and the fuel rail 22 for delivering fuel from a remote fuel source to openings 50 for the fuel injector 26.

Figure 4:
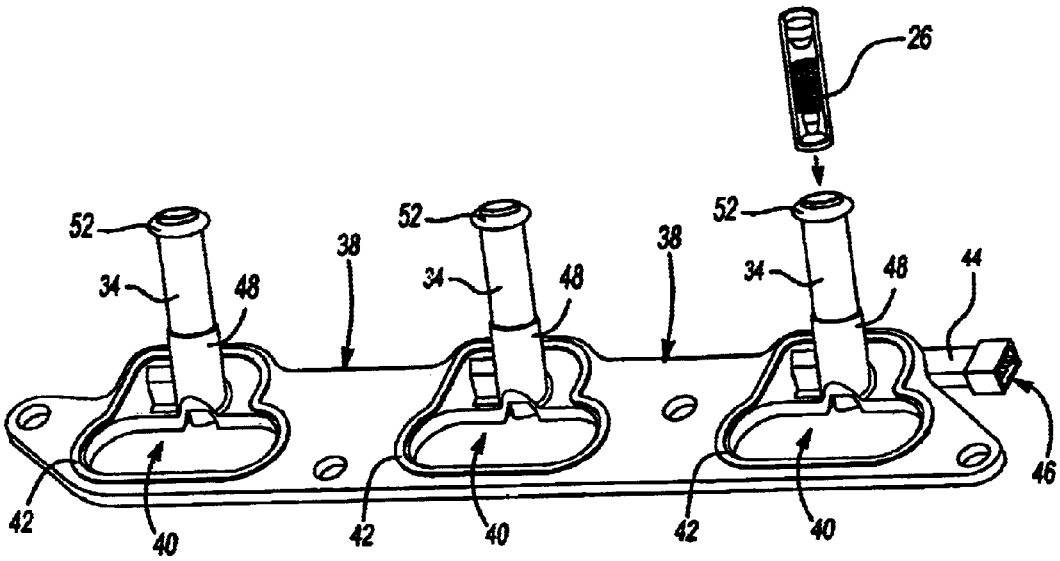
FIG. 4 is a perspective view of the injector pack assembly.
Figure 5:
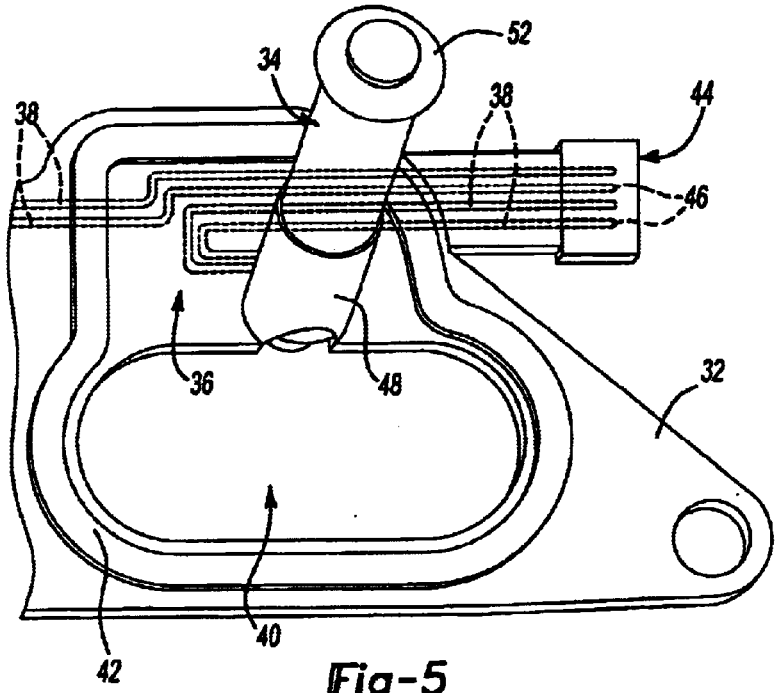
FIG. 5 is a perspective view of the lead frame disposed within a section of the injector pack assembly.
Figure 6:
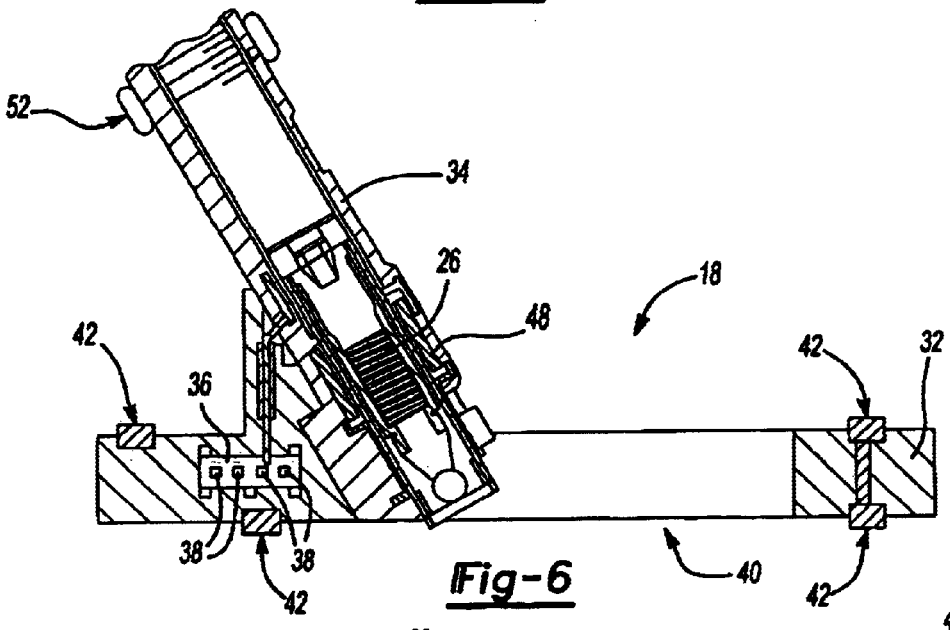
FIG. 6 is a cross-sectional view of the injector pack assembly.

Referring to FIGS. 4, 5 and 6, the injector pack 18 includes the plate segment 32 that is preferably a generally rectangular plate structure having a length, width and a thickness. The injector pack 18 is preferably fabricated from a plastic material capable of withstanding operating conditions consistent with an under hood environment. The plastic material can be any material capable of withstanding the temperature fluctuations, corrosive fluids and stresses encountered and common to the engine compartment. A worker skilled in the art with the benefit of this disclosure would be able to select a material capable of fulfilling application specific requirements.

The mount cylinder 34 includes a seal 52. The seal 52 seals within the opening 50 defined within the intake manifold 14 to provide communication of fuel to the fuel injector 26. The seal 50 is fabricated from a pliable material for sealing against the inner surface of the opening 50. The specific material selected for the seal 52 is fuel compatible. The seal 52 is molded to the injector pack 18. Preferably, the molding of the seal 52 to the injector pack 18 is by a two shot molding process, however other molding processes are within the contemplation of this invention. A two shot molding process is known in the art and includes molding with two different materials within a common mold. The two shot mold process provides for molding of the seal 52 to the injector pack 18, thereby eliminating subsequent assembly steps. Although, it is preferable to mold the seal 52 in a two shot process, it is also within the contemplation of this invention that the seal 52 be installed as a separate part. The seal 52 may be press fit within the mount cylinder 34, or installed to an outer diameter of the mount cylinder 34.

The seals 42 surrounding the intake opening 40 are also molded as an integral part of the injector pack 18. The seals 42 are disposed on a top and bottom surface of the injector pack 18 to seal against the intake manifold 12 and a surface of the engine 12 to which the intake manifold 14 is mounted. Further, although the seals 42 are preferably molded as an integral part of the injector pack 18, it is within the contemplation of this invention to use separately installed seals.

Figure 7:
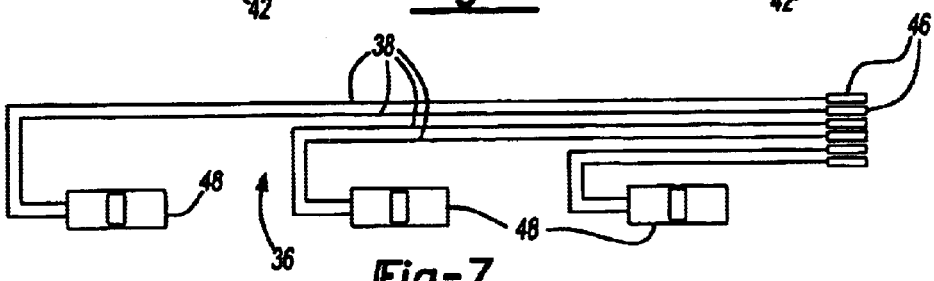
FIG. 7 is a schematic view of the lead frame of the injector pack assembly.

Referring to FIG. 7, the lead frame assembly 36 is shown schematically separate from the injector pack 18. The lead frame assembly 36 includes conductors 38 that communicate electrical signals to the coils 48. The lead frame assembly 36 illustrated includes separate conductors 38 for each coil 48 originating at a connector pin 46 that is over molded and formed within the main connector 44. The lead frame 36 is constructed of electrically conductive materials such as copper or any other known electrically conductive material. Because the lead frame 36 is encapsulated with the injector pack 18, insulation capable of withstanding the harsh engine environment is not required. Further, because the conductors 38 are concealed within the injector pack 18, the conductors 38 are not required to have significant structural strength as would be required of individual conductors for a conventional externally mounted wire harness in order to withstanding a desired amount of pulling or tugging. The number of conductors 38 provided is dependent on the application specific factors, such as the number and type of fuel injectors 26. The circuit pattern provided by the lead frame assembly 36 is shown schematically, and a worker skilled in the art with the benefit of this disclosure would be able to provide a lead frame assembly 36 in view of application specific requirements.

Referring to FIG. 8, another injector pack 60 according to this invention is shown and includes a plate segment 61 and a mount 86 for receiving a fuel injector 62. The fuel injector 62 includes a coil 63 and a connector 64. The connector 64 engages a connector 84 of the injector pack 60. The coil 63 is electrically connected to the lead frame assembly 68 within the injector pack 60 by the connector 84. The injector pack 60 includes a lead frame assembly 68 with a plurality of conductors 70 that terminate at the connector 84. The connector 84 includes connector pins 72 that cooperate with corresponding receiving connectors 65 of the connector 64.

The fuel injector 62 is received within the mount section 86 of the injector pack 60 and electrically connected by engagement of the connectors 64 of the fuel injector 62 with the connector 84 formed within the flange assembly 86. The coil 63 that generates the magnetic field required actuating the fuel injector and meter fuel into an intake opening 78. A seal 76 is disposed about the intake opening 78 for sealing between the intake manifold 14 and injector pack 60. Further, a seal 74 is provided on the fuel injector 62 for forming a seal with the fuel rail 22 supplying fuel.

The lead assembly 68 is over molded within the injector pack 60, but does not include the coil 63 required to generate the magnetic field for actuating the fuel injector 62. The fuel injectors 62 is received within the mount section 86 and electrically connected by engagement between the connector 64 of the fuel injector 62 with the connector 84 integrally formed within the injector pack 60. The connector 84 includes connector pins 72 that are attached to conductors 70 of the lead frame assembly 68. The fuel injector connector 64 includes mating pins 65 that correspond to the connector pins 72. The conductors 70 of the lead frame assembly 68 are electrically connected to a connector pins 82 of the main connector 80. The main connector 80 is connected to a main controller disposed within the vehicle. The main controller triggers actuation of the fuel injector 62 at desired intervals to meter fuel entering the combustion chamber.

Referring to FIG. 9 a flange assembly according to this invention is generally indicated at 100 and includes a plate segment 102 and a main connector 116. The flange assembly 100 is an embodiment including a lead frame assembly 108 for communicating electrical signals to fuel injectors, and seals 106. A lead frame assembly 108 is encapsulated within the plate segment 102 and includes conductors 110 that form an electrical connection between connector pins 118 within the main connector 116 and connectors 114.

The plate segment 102 defines a plurality of intake openings 104 and is assembled between an intake manifold (not shown) and a cylinder head of an internal combustion engine. The flange assembly 100 provides for sealing between the intake manifold and the cylinder head by including integral seals 106 on a top and bottom surface 126, 128 of the plate segment 102. The seals 106 are preferably a molded portion of the flange assembly 100, however, the seals 106 may also be separately installed or placed seals as are known.

The plate 102 shown in FIG. 9 is of one piece and provides intake openings and electrical connectors 114 for all fuel injectors that are to be assembled to an engine. As appreciated, the plate 102 may provide seals 106 and connectors 114 for any number of cylinders and may also be divided to provide electrical connection and sealing for only one side of engine. A worker skilled in the art with the benefit of this disclosure would understand the possible modifications within the contemplation of this invention to provide for specific application requirements.

The flange assembly 100 includes the connectors 114 for engagement to electric devices such as for example fuel injectors, or sensors. The connectors 114 include pin connectors 120 that are connected to wires 112. The wires 112 are conventionally configures including a conductor encased within insulation. The insulation is provided to withstand the application specific requirements.

Figure 10:
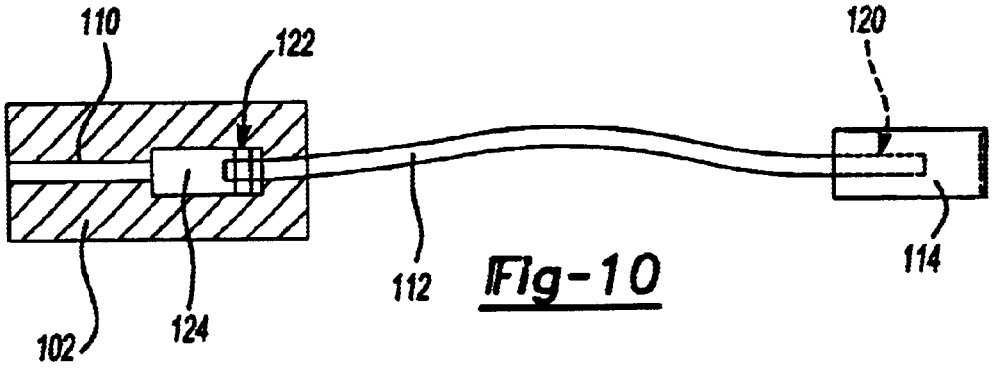
FIG. 10 is a partial sectional view of wire connection to the encapsulated lead frame assembly.

Referring to FIG. 10, the wire 112 extends a distance into the plate segment 102 and is attached to the conductors 110 of the lead frame assembly 108. A terminal 124 provides attachment 122 between the lead frame conductors 110. The terminal 124 can be of any kind known to a worker skilled in the art including, for example a crimp terminal, or insulation displacement terminal. The terminal 124 and wire connection 122 along with a portion of the wire 112 are encapsulated within the plate 102 to provide protection for the connection.

The flange assembly 100 provides for the electrical connection of various electrical devices without a cumbersome and exposed wire harness assembly. Further, the flange assembly 100 includes external connectors 114 that provides for the electrical connection between other types of devices for other engine systems to further eliminate the use of exposed wiring harness.

Figure 11:
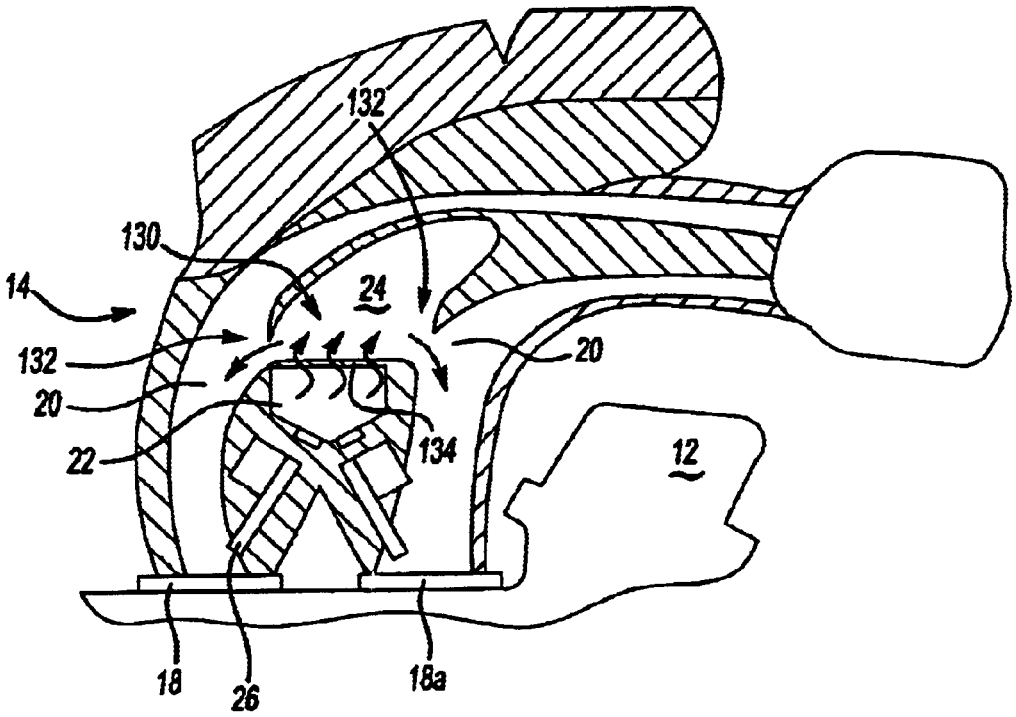
FIG. 11 is a schematic view of the fuel rail according to this invention.
Figure 12:
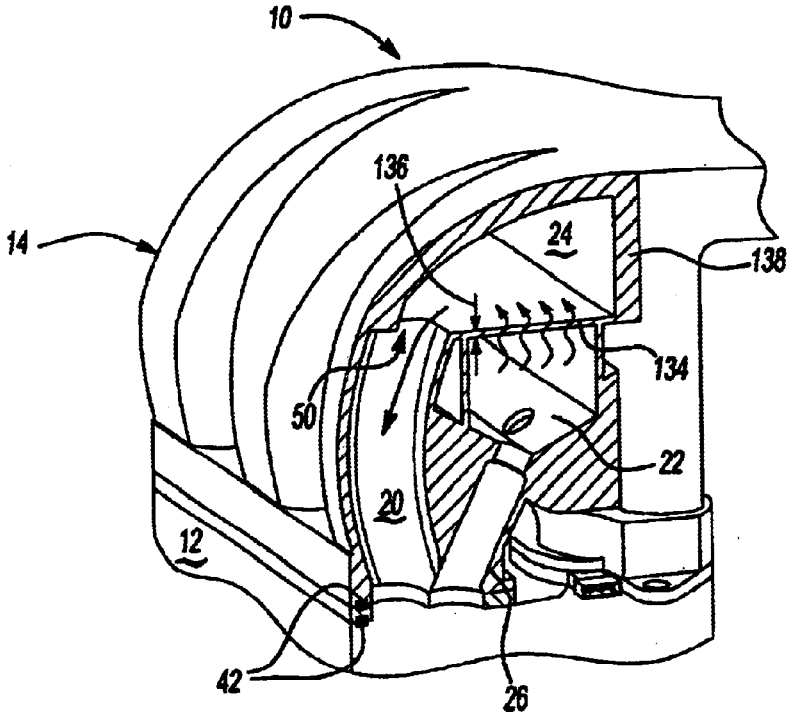
FIG. 12 is a perspective view of the fuel rail and an air intake passage according to this invention.

Referring to FIGS. 11 and 12, the intake manifold 14 defines the plurality of air intake passages 20. The fuel injectors 26 meter fuel supplied from the fuel rail 22 into the air intake passages 20. The fuel is combined with air to provide the desired air fuel mixture to the engine 12. Fuel within the fuel rail 22 is under a pressure causing a bias outward from the fuel rail 22. A small amount of fuel within the fuel rail 22 permeates as vapors 130 into the cavity 24. Openings 132 communicate fuel vapors 130 within the cavity 24 to at least one of the air intake passages 20. Fuel vapors 130 within the air intake passages 20 are drawn into the engine 12 and burned in the combustion process. Fuel vapors 130 within the cavity 24 are prevented from permeating through the non-metallic intake manifold 14 and into the atmosphere. Instead of permeating through the non-metallic manifold 14, the fuel vapors 130 are drawn into the engine 12.

The cavity 24 includes a common wall 134 with the fuel rail 18. The common wall 134 is preferably of a thickness 136 less than walls 138 that form the remainder of the cavity 24 and the fuel rail 22. The thinner wall 134 provides a path of least resistance for the small amount of fuel vapors 130 that may permeate from the fuel rail 22. The reduced resistance to fuel vapor 130 permeation provides a desired path that limits permeation of fuel vapors 130 through the other walls 138.

Air flow through the air intake passages 16 creates a pressure differential that draws fuel vapors 26 contained within the cavity 20 through the air intake passages 20 and into the engine 12 instead of progressing through the non-metallic intake manifold portion 14 and into the atmosphere. Fuel within the fuel rail 22, is under a pressure greater than atmosphere, required to drive fuel through the injectors 26 and into the combustion chamber. It is the increased pressure of fuel within the fuel rail 22 that tends to cause the permeation of fuel vapors through the non-metallic material forming the intake manifold 14. The cavity 24 is formed above and along the entire length of the fuel rail 22 to provide a path for the small amount of permeating fuel vapors 130. Fuel vapors permeating from any part of the fuel system, such as through seals between the injector pack or the fuel injector will be trapped in the cavity 20 and channeled back into the air intake passages 16.

Communication of the cavity 24 with the air intake passages 20 creates a pressure differential between the fuel rail 22 and the cavity 24. The pressure differential between the cavity 24 and fuel rail 22 provides the most desirable path for the slight amount of fuel vapors 130 emitted. The pressure differential between the fuel rail 22 and the cavity 24, along with the thinner common wall 134 prevents substantially all fuel vapors from being emitted into the atmosphere by routing any fuel vapors 130 into the engine 12.

Figure 13:
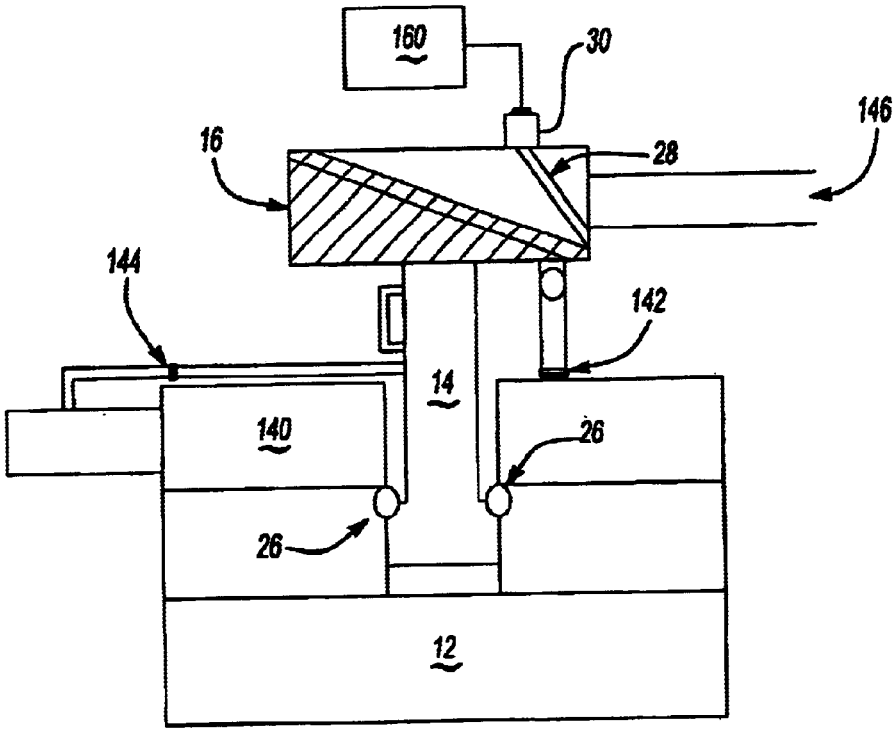
FIG. 13 is a schematic view of a fuel vapor emission absorber according to this invention.

Referring to FIG. 13, the air cleaner assembly 16 includes a fuel vapor absorber 28 and an actuator 30. When the engine 12 is not running unburned fuel, particularly hydrocarbons, are released into the fuel intake system 10 into from the engine 12, through the intake manifold 14, and through crankcase ventilation valves 142, 144. As appreciated, once hydrocarbons are released into the intake manifold 14, they can be released into the atmosphere through an air inlet passage 146. The absorber 28 closes and prevents the release of fuel vapors from the engine 12 into the atmosphere. The absorber 28 is moved between an open position that allows unrestricted airflow, and a closed position that prevents the release of fuel vapors through the intake manifold 14.

Figure 14:
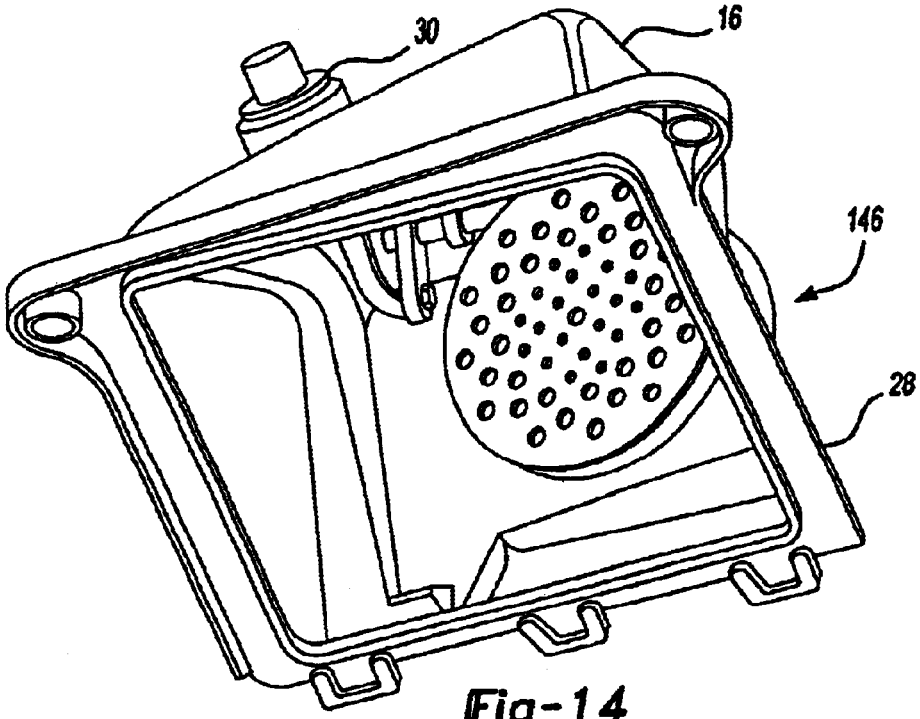
FIG. 14 is a perspective view of a fuel vapor emission absorber according to this invention.
Figure 15:
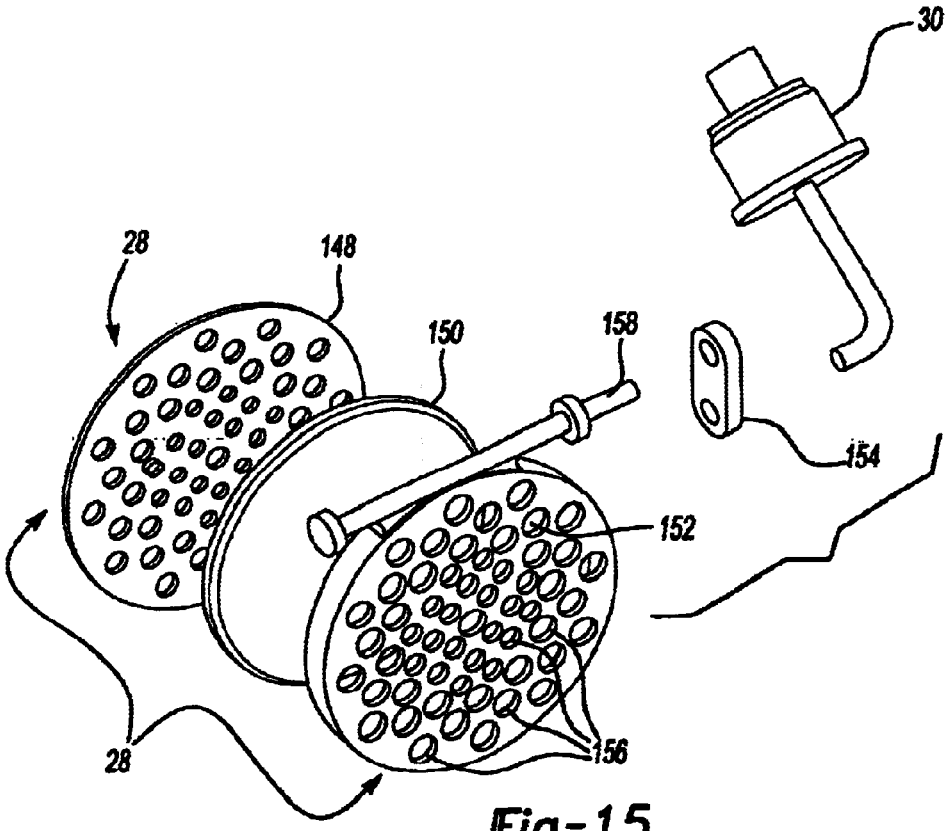
FIG. 15 is a perspective view of components of the fuel vapor emission absorber.

Referring to FIGS. 14 and 15, the air cleaner assembly 16 includes the absorber 28. The absorber 28 selectively blocks the air inlet passage 146 in response to the position of the actuator 30. Preferably, the absorber 28 includes a charcoal filter 150 sandwiched between a back plate 148 and a front plate 152. Each of the front and back plates 142, 148 includes a plurality of openings 156. As appreciated, a worker skilled in the art with the benefit of this application would understand that any fuel vapor absorbent material can be use with this invention. The front plate 152 includes an actuation rod 158 attached through a link 154 to the actuator 30. Linear movement of the actuator 30 moves the absorber between open and closed positions. As appreciated, the actuator 30 is as known to worker skilled in the art, for example an electric motor or a vacuum actuator.

In operation, a vehicle controller 160 controls the actuator. Once the engine 12 is turned off the actuator 30 moves the absorber 28 into a closed position to cover the air inlet passage 146. The absorber 28 then absorbs fuel vapors released into the intake manifold 14 from the engine 12. Fuel vapors, typically hydrocarbons, are released from the engine 12 and from within the valve covers into the air cleaner assembly 16. The absorber 28 prevents emission through the air inlet passage 146 into the atmosphere.

Upon restarting of the engine 12 the absorber 28 remains in the closed position for a predetermined start up time to purge any released fuel vapors. That is, the absorber 28 remains closed, until the engine 12 begins drawing fuel vapors back into the combustion chamber.

The foregoing description is exemplary and not just a material specification. The invention has been described in an illustrative manner, and should be understood that the terminology used is intended to be in the nature of words of description rather than of limitation. Many modifications and variations of the present invention are possible in light of the above teachings. The preferred embodiments of this invention have been disclosed, however, one of ordinary skill in the art would recognize that certain modifications are within the scope of this invention. It is understood that within the scope of the appended claims, the invention may be practiced otherwise than as specifically described. For that reason the following claims should be studied to determine the true scope and content of this invention.

What is claimed is:

1. An intake manifold assembly comprising:

a plate portion defining a segment between said intake manifold and a vehicle engine component, said plate portion comprises a valve mount cylinder defining an opening for fuel injector received within said mount cylinder;

a lead frame encapsulated within said plate portion, said lead frame comprising a plurality of electrical conductors for communicating electrical signals to at least one electrical device;

a main connector body defined by said plate portion and in electrical communication with said lead frame; and wherein said valve mount cylinder comprises a coil in electrical communication with said lead frame, and coil is enclosed within said mount cylinder.

2. The assembly of claim 1, comprising a seal disposed about an outer surface of said mount cylinder to seal with a fuel source.

3. The assembly of claim 1, wherein said plate portion comprises a remote connector attachable to an injector connector of said fuel injector.

4. The assembly of claim 1, wherein said plate portion defines an intake opening.

5. The assembly of claim 4, wherein said plate potion comprises a seal disposed about said intake opening.

6. The assembly of claim 4, wherein a first of said is disposed on a top portion of said plate portion, and another of said seals is disposed on a bottom portion of said plate portion.

7. The assembly of claim 1, comprising a plurality of connectors attached to said lead assembly.

8. The assembly of claim 7, wherein said plurality of connectors includes a wire portion attached to said lead frame assembly.

9. The assembly of claim 8, wherein said attachment between said lead frame and said wire comprises a crimp connector.

10. The assembly of claim 8, wherein said attachment between said lead frame and said wire comprises an insulation displacement terminal.

11. The assembly of claim 1, wherein said plate portion comprises a non-metallic material.

* * * * *